US011110494B2

(12) United States Patent
Yerkes

(10) Patent No.: US 11,110,494 B2
(45) Date of Patent: Sep. 7, 2021

(54) VACUUM CLOG TOILET REMOVAL APPARATUS

(71) Applicant: William John Yerkes, Deerfield Beach, FL (US)

(72) Inventor: William John Yerkes, Deerfield Beach, FL (US)

( * ) Notice: Subject to any disclaimer, the term of this patent is extended or adjusted under 35 U.S.C. 154(b) by 0 days.

(21) Appl. No.: 16/458,420

(22) Filed: Jul. 1, 2019

(65) Prior Publication Data

US 2021/0001384 A1 Jan. 7, 2021

(51) Int. Cl.

| | |
|---|---|
| ***B08B 9/035*** | (2006.01) |
| ***E03C 1/308*** | (2006.01) |
| ***E03D 9/16*** | (2006.01) |

(52) U.S. Cl.

CPC ..... *B08B 9/035* (2013.01); *E03C 1/308* (2013.01); *E03D 9/16* (2013.01)

(58) Field of Classification Search

None

See application file for complete search history.

(56) References Cited

U.S. PATENT DOCUMENTS 5,852,834 A * 12/1998 Harvey ..... E03D 9/00 4/255.01

2015/0020297 A1* 1/2015 Durkin ..... E03F 9/00 4/255.03

* cited by examiner

*Primary Examiner* — Mikhail Kornakov
*Assistant Examiner* — Pradhuman Parihar
(74) *Attorney, Agent, or Firm* — Meunier Carlin & Curfman LLC

(57) ABSTRACT

A plumbing clog removal apparatus that includes a vacuum chamber having an inlet, an outlet, and a compressor port. The clog removal apparatus also includes an inlet seal disposed at the vacuum chamber inlet. The vacuum chamber inlet seal is movably coupled to the vacuum chamber inlet and is movable between an open position and a closed position. The plumbing clog removal apparatus also includes, an outlet seal disposed at the vacuum chamber outlet. The outlet seal is movably coupled to the vacuum chamber outlet and is movable between an open position and a closed position. The vacuum chamber also includes an air compressor fluidically connected to the vacuum chamber compressor port. The compressor is configured to remove air from the compressor chamber and form a low pressure condition inside the vacuum chamber.

10 Claims, 3 Drawing Sheets

VACUUM CLOG TOILET REMOVAL APPARATUS

BACKGROUND

The need to remove clogs in plumbing systems exists in the maintenance of most plumbing systems. In a plumbing system there is often a possibility that blockage materials will building up in the plumbing system and limit the ability for water or other fluids to pass through it freely. Many plumbing systems are used for disposing of waste and other items that cannot easily pass through a plumbing system of a limited diameter. Typically, a plumbing system has bends and curves that create locations that materials can build up in. Such bends and curves can and limit the free flow of fluid as well. In toilet systems particularly, a hand plunger is typically used to manually pressurize and depressurize a septic line and create movement therein to of dislodging a clog. Toilet systems are typically designed to maintain bends in their plumbing designs by necessity and often require the use of such hand plungers.

SUMMARY

Various implementations include, a plumbing clog removal apparatus. The clog removal apparatus includes a vacuum chamber having an inlet, an outlet, and a compressor port. The clog removal apparatus also includes an inlet seal disposed at the vacuum chamber inlet. The vacuum chamber inlet seal is movably coupled to the vacuum chamber inlet and is movable between an open position and a closed position. The plumbing clog removal apparatus also includes, an outlet seal disposed at the vacuum chamber outlet. The outlet seal is movably coupled to the vacuum chamber outlet and is movable between an open position and a closed position. The vacuum chamber also includes an air compressor fluidically connected to the vacuum chamber compressor port. The vacuum chamber includes at least one actuator configured to open and close the inlet seal and the outlet seal. The vacuum chamber also includes at least one pressure sensor disposed inside the vacuum chamber. The compressor is configured to remove air from the compressor chamber and form a low pressure condition inside the vacuum chamber. The actuator is configured to open the inlet seal when the pressure sensor senses the low pressure condition.

In some implementations the inlet seal and the outlet seal form an airtight seal on the vacuum chamber when deposed in the closed position.

In some implementations, the vacuum chamber inlet is configured to be fluidically connected to a toilet waste pipe.

In some implementations, the vacuum chamber outlet is configured to be fluidically connected to a building plumbing system.

In some implementations, the low pressure condition is a vacuum.

In some implementations, the diameter of the vacuum chamber is between [-] and [-].

In some implementations the plumbing clog removal apparatus also includes an actuator switch, wherein the actuator switch is configured to activate the air compressor.

In some implementations, the plumbing clog removal apparatus further comprises a controller.

In some implementations, the pressure sensor is configured to send a signal to the controller when the pressure sensor senses the low pressure condition. The controller is configured to deactivate the air compressor, open the inlet seal once the controller receives the signal from the controller, and subsequently open the outlet seal.

In some implementations the vacuum chamber also includes a cleaning port. The cleaning port is configured to direct pressurized water into the vacuum chamber.

Various other implementations include, a plumbing clog remover toilet system. The plumbing clog remover toilet system includes a plumbing clog removal apparatus. The plumbing clog removal apparatus includes a vacuum chamber having an inlet, an outlet, and a compressor port. The plumbing clog removal apparatus includes an inlet seal disposed at the vacuum chamber inlet. The plumbing clog removal apparatus includes an outlet seal disposed at the vacuum chamber outlet. The plumbing clog removal apparatus includes an air compressor fluidically connected to the vacuum chamber compressor port. The plumbing clog removal apparatus includes at least one actuator configured to open and close the inlet seal and the outlet seal. The plumbing clog removal apparatus also includes at least one pressure sensor disposed inside the vacuum chamber. The compressor is configured to remove air from the compressor chamber and create a low pressure condition inside the vacuum chamber. The actuator is configured to open the inlet seal once a low pressure region is created in the vacuum chamber. The actuator is also configured to open the outlet seal after the inlet seal has opened. The plumbing clog remover toilet system also includes a toilet having a toilet a waste pipe. The toilet waste pipe outlet is fluidically coupled to the vacuum chamber inlet.

In some implementations, the inlet seal and the outlet seal form an airtight seal on the vacuum chamber when deposed in the closed position.

In some implementations, the vacuum chamber outlet is configured to be fluidically connected to a building plumbing system.

In some implementations, the low pressure condition is a vacuum.

In some implementations, the system also includes an actuator switch. The actuator switch is configured to activate the air compressor.

In some implementations, the system also includes a controller.

In some implementations, the pressure sensor is configured to send a signal to the controller when the pressure sensor senses the low pressure condition. The controller is configured to deactivate the air compressor, open the inlet seal once the controller receives the signal from the controller, and subsequently open the outlet seal.

In some implementations, the vacuum chamber also includes a cleaning port. The cleaning port is configured to direct pressurized water into the vacuum chamber.

Various other implementations include a method of removing a clog from a plumbing system. The method includes receiving a signal to activate a plumbing clog removal apparatus. The plumbing clog removal apparatus includes a vacuum chamber having an inlet, an outlet, and a compressor port. The vacuum chamber also includes an inlet seal disposed at the vacuum chamber inlet and an outlet seal disposed at the vacuum chamber outlet. The plumbing clog removal apparatus also includes an air compressor fluidically connected to the vacuum chamber compressor port. The plumbing clog remover also includes at least one actuator configured to open and close the inlet seal and the outlet seal and at least one pressure sensor disposed inside the vacuum chamber. The method includes sending a signal to an actuator to close the vacuum chamber inlet seal, and the vacuum chamber outlet seal. The method includes sending a signal to the air compressor to activate. The method includes receiving a signal indicating the low pressure condition inside the vacuum chamber. The method includes sending a signal to the actuator to open the vacuum chamber inlet seal. The method includes sending a signal to the actuator to open the vacuum chamber outlet seal.

DETAILED DESCRIPTION

It should be understood at the outset that although illustrative implementations of one or more embodiments are illustrated below, the disclosed systems and methods may be implemented using any number of techniques, whether currently known or in existence. Like numbers represent like parts throughout the various figures, the description of which is not repeated for each figure. The disclosure should in no way be limited to the illustrative implementations, drawings, and techniques illustrated below, but may be modified within the scope of the appended claims along with their full scope of equivalents. Use of the phrase "and/or" indicates that any one or any combination of a list of options can be used. For example, "A, B, and/or C" means "A", or "B", or "C", or "A and B", or "A and C", or "B and C", or "A and B and C".

Traditional hand plungers are inserted in the water of clogged toilets to clear a clog. Typically, a traditional plunger is placed stored on the floor of a bathroom or in a nearby case. After a hand plunger is used, the residue of the plunger often leaves rings of residue, which can include sewage water and human waste that grow bacteria. This can create undesirable and unsanitary conditions. Additionally, a user must manually interact with the often-unsanitary sewage water to clear the clog. In large buildings and other applications where there is a need to maintain a large number of toilets, it can be cumbersome and uneconomic to use hand plungers to clear clogs when they occur. A plumbing clog remover that utilizes a vacuum chamber to pull clogs through a plumbing network can allow a user to automatically remove clogs without having to interact with each clog for extended periods of time. A user also, no longer needs to interact with the sewage and does not input or remove any objects into the sewage water, which allows a user to clear a plumbing clog without the potential spread of bacteria and waste.

Figure 1:
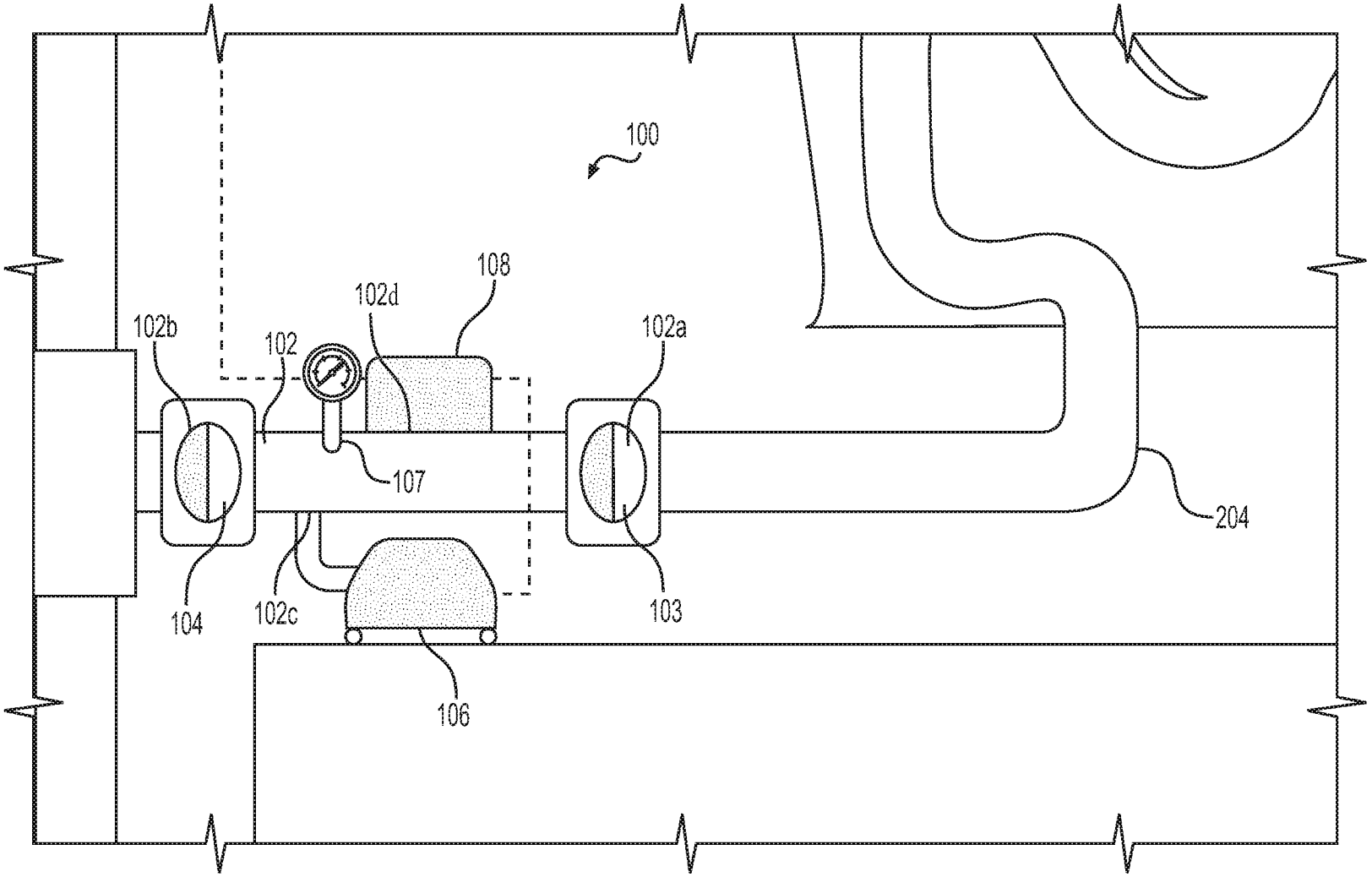
FIG. 1 shows a cutaway view of a plumbing clog remover.

FIG. 1 illustrates a plumbing clog removal apparatus 100. In some implementations, the plumbing clog removal apparatus 100 includes a vacuum chamber 102 having an inlet 102*a*, an outlet 102*b*, and a compressor port 102*c*. In some implementations, the vacuum chamber 102 is formed in a cylindrical shape and has a cylindrical body 102*d*, forming an inner volume. The vacuum chamber 102 can have a diameter that is adapted to fit within a building plumbing system. The inlet 102*a* and the outlet 102*b* can be formed to interface with a standard plumbing system. In some implementations, the diameter of the inlet 102*a* and the outlet 102*b* are uniform with standard plumbing pipe. In some implementations, the inlet 102*a* is formed to interface directly with a toilet waste pipe (shown in FIG. 2), having a uniform diameter with the toilet waste pipe. In some implementations the vacuum chamber 102 is of a uniform diameter. The compressor port 102*c* is disposed in the body 102*d* of the vacuum chamber 102 and is fluidically connected to the inner volume of the cylindrical chamber body 102*d* of the vacuum chamber 102. The compressor port 102*c* is configured to interface with an air compressor 106 such that air can be removed from the vacuum chamber 102 through the compressor port 102*c*. In some implementations, the compressor port 102*c* is a one-way port 102*c* that allows fluid, such as air, to be removed from the inner volume of the vacuum chamber 102 but does not allow fluid to be added to the inner volume through the compressor port 102*c*. In some implementations, the compressor port 102*c* is an air compressor check valve. In some implementations, the vacuum chamber 102 is made from polyvinyl chloride (PVC), copper, plastic, or any other material that can be used to form a plumbing fixture.

In some implementations, the plumbing clog remover 100 includes an inlet 102*a* seal 103 that is movably coupled to the vacuum chamber 102 inlet 102*a*. In some implementations the plumbing clog remover 100 includes an outlet 102*b* seal 104 that is movably coupled to the vacuum chamber 102 outlet 102*b*. The inlet 102*a* seal and the outlet 102*b* seal 104 are each airtight and seal off the vacuum chamber 102 from the outside atmosphere when in a closed position. The inlet seal 103 and the outlet seal 104 are moveable between an open position and the closed position. In some implementations the inlet 102*a* seal and the outlet 102*b* seal 104 are partially airtight seals, and in some implementations, the inlet 102*a* seal and the outlet 102*b* seal 104 are fully airtight seals. In some implementations, the inlet 102*a* seal and the outlet 102*b* seal 104 are each a door that can be closed and opened by turning a knob to allow fluid flow into the vacuum chamber 102. The inlet 102*a* seal and the outlet 102*b* seal 104 can each be a ball valve, a gate valve, a diaphragm valve, or any other sealable valve that can be used to block and allow fluid flow through a vacuum chamber 102. The inlet 102*a* seal and the outlet 102*b* seal 104 are connected to the vacuum chamber 102 inlet 102*a* and the vacuum chamber 102 outlet 102*b* using threaded grove connection, a bonding agent such as glue or epoxy, or any other connector that can be used to connect a vacuum chamber 102 to a plumbing fixture. In some implementations, the plumbing clog remover 100 includes an air compressor 106. The air compressor 106 is configured to remove air from the vacuum chamber 102. In some implementations, the vacuum chamber 102 is connected to the compressor port 102*c*. The air compressor 106 is fluidically connected to the compressor port 102*c* and the inner volume of the vacuum chamber 102. The air compressor 106 can be electrically powered rotary air compressor 106. The air compressor 106 can be a tankless air compressor 106 or utilize a tank. Although a tankless rotary air compressor 106 is illustrated in FIG. 1 any air compressor 106 can be used that is capable of removing air from a vacuum chamber 102.

The plumbing clog removal apparatus 100 has an actuator 108 that can open and close the inlet 102*a* seal and the outlet 102*b* seal 104. In some implementations, the inlet 102*a* seal and the outlet 102*b* seal 104 each have a respective actuator 108. The actuator 108 can be a manual device such a knob that is configured to interact with the inlet 102*a* seal and the outlet 102*b* seal 104 where the inlet 102*a* seal and the outlet 102*b* seal 104 can be opened and closed using the knob. For example, where the inlet 102*a* seal and the outlet 102*b* seal 104 are ball valves, a knob can be coupled to the valve such that rotation of the knob rotates the ball valve. In some implementations, the actuator 108 is a motor, a spring, or a piston, such that the motor spring or piston are capable of instantaneously, or quickly opening and closing the inlet 102*a* seal and the outlet 102*b* seal 104 allowing air pressure to quickly change inside the vacuum chamber 102. In some implementations air compressor 106 creates a low pressure condition inside the vacuum chamber 102. The air compressor 106 can remove air from the vacuum chamber 102 that creates a pressure sufficient to remove a clog or a complete vacuum. The instantaneous opening of the inlet 102*a* seal when there is a low pressure condition inside the inner volume of the vacuum chamber 102, forms a pressure differential that results in a pulling force, that causes the higher air pressure fluid upstream of the vacuum chamber 102 inlet 102*a* to rush into the low pressure region, pulling in material, and fluids that are fluidically connected to the vacuum chamber 102, into the vacuum chamber 102. The plumbing clog remover 100 further has at least one pressure sensor 107 disposed inside the vacuum chamber 102, that is configured to detect the pressure inside the vacuum chamber 102. The pressure sensor 107 can be configured to send a signal to a display to show the pressure that indicates the pressure inside the vacuum chamber 102. The pressure sensor 107 can also be configured to manually display a pressure on a dial or some other manual display. The pressure sensor 107 can also be configured to relay a signal to the at least one actuator 108, to automatically activate the at least one actuator 108 to open the inlet 102*a* seal when the air pressure meets a predetermined low pressure condition, which can be a vacuum or some other predetermined low pressure condition.

Figure 2:
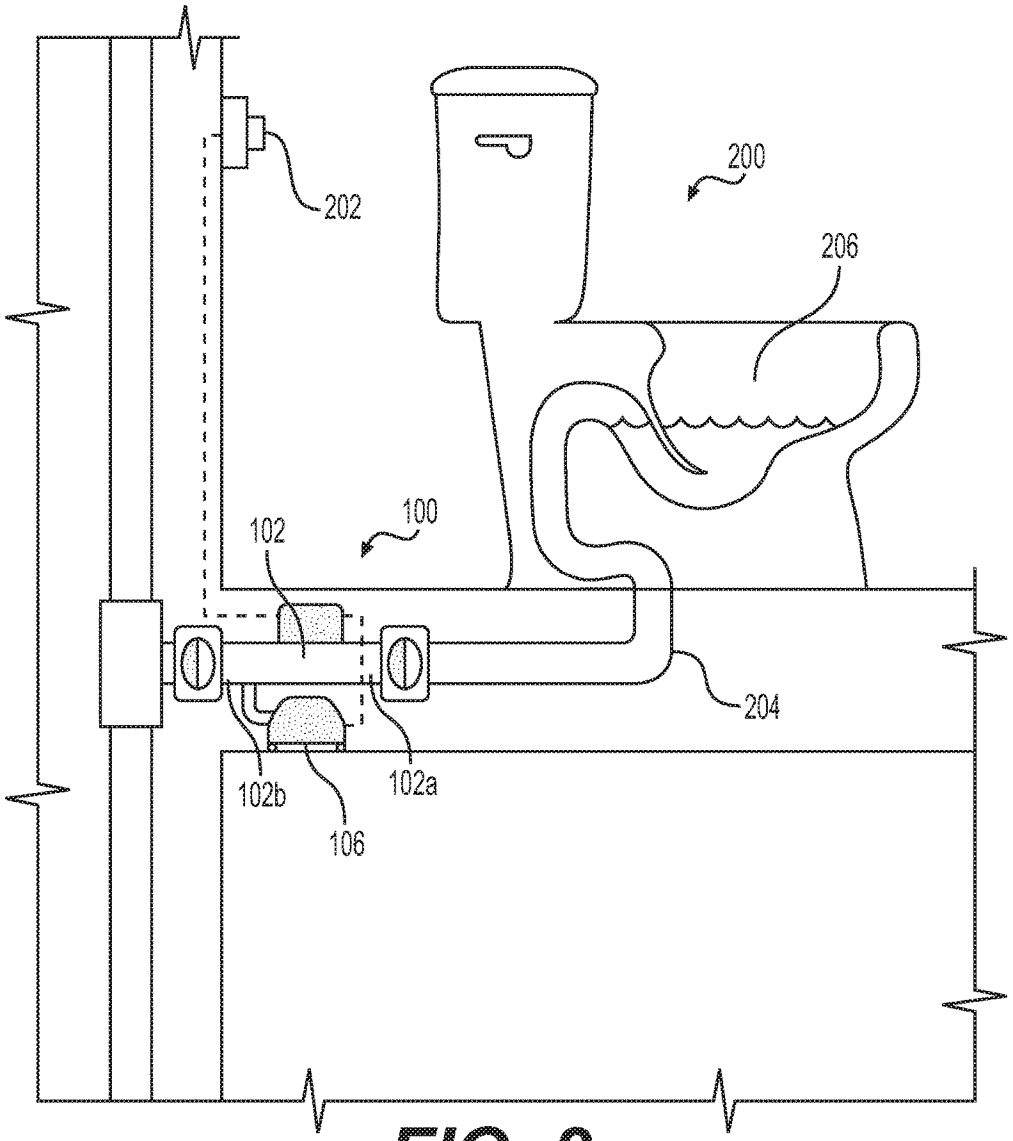
FIG. 2. shows a cutaway view of a plumbing clog remover toilet system.

FIG. 2 illustrates an example implementation of the plumbing clog removal apparatus 100 of FIG. 1 as integrated into a building plumbing system. The plumbing clog remover inlet 102*a* is coupled to a toilet and a building plumbing system. Specifically, the vacuum chamber 102 inlet 102*a* is fluidically coupled to a toilet waste pipe 204, and the vacuum chamber 102 outlet 102*b* is fluidically coupled to a building plumbing system. The toilet waste pipe 204 is fluidically connected to the toilet bowl 206, which contains, a set amount of water.

The system also includes an actuator switch 202 that controls the function of the plumbing clog remover. In some implementations, the actuator switch 202 is engaged to close the vacuum chamber 102 seals, activate the air compressor 106, open the vacuum chamber 102 seals. Although FIG. 2 shows the switch to be a button, in some implementations, the actuator switch 202 is a lever, a knob, a touch screen or any other user interface capable of being engaged to activate the plumbing clog remover. The toilet is configured to retain water in the toilet bowl 206 and in part of the waste pipe 204 until it is flushed. When the toilet bowl 206 is flushed, water from a reservoir pushes the water down the waste pipe 204. In the case of a plumbing clog in the waste pipe 204, this water will pressurize a blockage in the direction of the plumbing clog remover. In some implementations, this configuration can aid in moving blockage toward the plumbing clog remover and the building plumbing system. Additionally, water from the toilet can be used to further clean the vacuum chamber 102 when the plumbing clog remover has been used.

Figure 3:
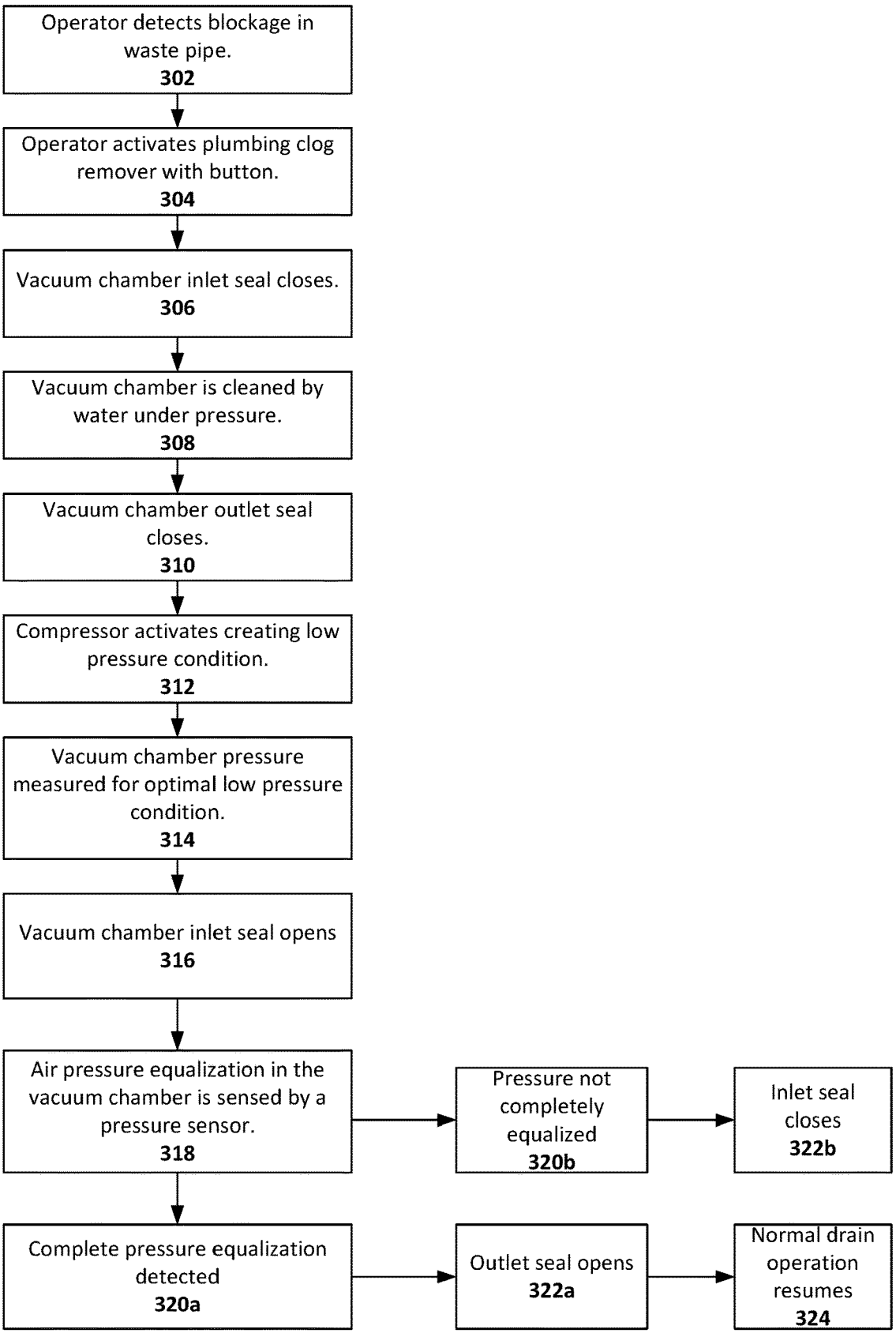
FIG. 3 is a flow chart of a method of operation for the plumbing clog remover toilet system.

FIG. 3 is a flow chart showing an example method of use for the plumbing clog removal apparatus 100 as shown in FIG. 1, and the plumbing clog remover toilet system 200 as shown in FIG. 2. At 302, an operator detects a blockage in the toilet waste pipe 204. This may be detected by the over-filling of water in the toilet and a lack of apparent draining if the toilet is flushed. At 304, the operator activates the plumbing clog remover with the actuator switch 202. Although a button is shown in FIG. 3, As discussed above, the actuator switch 202 can be a button, a lever, a knob, a touch screen, or any other user interface capable of being engaged to activate the plumbing clog remover. The actuator switch 202 sends a signal to the actuator 108 which initiates closing of the inlet 102*a* seal. In some implementations, the actuator switch 202 sends a signal to a controller that controls the functions of the plumbing clog remover and relays the command to close to the inlet 102*a* seal. At 306, the vacuum seal inlet 102*a* closes. At 308, the vacuum chamber 102 is cleaned by water under pressure, this water under pressure can be funneled into the vacuum chamber 102 from the toilet through a separate cleaning port (not shown), or through an alternative water source. At 310 the vacuum chamber 102 outlet 102*b* seal 104 closes. The controller can send a signal to the actuator to close the vacuum outlet 102*b* seal. In some implementations, the vacuum chamber 102 outlet 102*b* seal can be manually closed by a user. At, 312, the air compressor 106 initiates, pulling the air out of the vacuum chamber 102 creating the low pressure condition. At 314, the pressure sensor 107 measures the pressure in the vacuum chamber 102, to determine if the optimal low pressure condition has been reached inside the vacuum chamber 102. At 316, the vacuum chamber 102 inlet 102*a* seal opens and exposes the low pressure condition to the waste tube 204 causing matter and fluids to advance toward the low pressure region from the higher pressure region in the waste tube 204. Additionally, pressurized water from the toilet adds additional force to push a clog in the direction of the vacuum chamber 102. At 318, The pressure sensor 107 senses the air pressure in the vacuum chamber 102 and determines that whether the pressure is completely equalized (at 320*a*) or not completely equalized (at 320*b*). If the pressure is completely equalized, the outlet 102*b* seal 104 opens at 322*a* and normal drain operation resumes, at 324. If the pressure is not completely equalized, at 322*b*, the inlet 102*a* seal 103 closes, at 322*b*, until pressure equalization is sensed.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A plumbing clog removal apparatus, comprising: a vacuum chamber having an inlet, an outlet, and a one-way vacuum chamber compressor port adapted to only provide for the removal of air from the vacuum chamber; an inlet seal disposed at the vacuum chamber inlet, wherein the inlet seal is movably coupled to vacuum chamber inlet and is movable between an open position and a closed positon; an outlet seal disposed at the vacuum chamber outlet, wherein the outlet seal is movably coupled to the vacuum chamber outlet and is movable between an open position and a closed position; an air compressor fluidically connected to the one-way vacuum chamber compressor port; at least one actuator configured to open and close the inlet seal and the outlet seal; and at least one pressure sensor disposed inside the vacuum chamber, wherein the air compressor removes air from an air compressor chamber to form a low pressure condition inside the vacuum chamber, and wherein the actuator opens the inlet seal when the pressure sensor senses the low pressure condition.

2. The plumbing clog removal apparatus of claim 1, wherein the inlet seal and the outlet seal form an airtight seal on the vacuum chamber when deposed in the closed position.

3. The plumbing clog removal apparatus of claim 1, wherein the vacuum chamber inlet is configured to be fluidically connected to a toilet waste pipe.

4. The plumbing clog removal apparatus of claim 1, wherein the vacuum chamber outlet is configured to be fluidically connected to a building plumbing system.

5. The plumbing clog removal apparatus of claim 1, wherein the low pressure condition is a vacuum.

6. The plumbing clog removal apparatus of claim 1, wherein a diameter of the vacuum chamber is adapted to engage a building plumbing system.

7. The plumbing clog removal apparatus of claim 1, further comprising an actuator switch, wherein the actuator switch is configured to activate the air compressor.

8. The plumbing clog removal apparatus of claim 1, further comprising a controller.

9. The pluming clog removal apparatus of claim 8, wherein the pressure sensor is configured to send a signal to the controller when the pressure sensor senses the low pressure condition and wherein the controller is configured to deactivate the air compressor, open the inlet seal once the controller receives the signal from the controller, and subsequently open the outlet seal.

10. The plumbing clog removal apparatus of claim 1 wherein the vacuum chamber further comprises a cleaning port, wherein the cleaning port is configured to direct pressurized water into the vacuum chamber.

* * * * *